United States Patent [19]

Lerner et al.

[11] Patent Number: 4,731,029

[45] Date of Patent: Mar. 15, 1988

[54] WIRE AND CABLE MANAGER

[75] Inventors: Lawrence Lerner, Beverly Hills; Stephen P. Diskin, Los Angeles, both of Calif.

[73] Assignee: MEGA/ERG Inc., Beverly Hills, Calif.

[21] Appl. No.: 922,534

[22] Filed: Oct. 23, 1986

[51] Int. Cl.[4] ..... H01R 19/14

[52] U.S. Cl. ..... 439/4

[58] Field of Search ..... 339/119 C, 147 C, 154 R, 339/154 A, 156 R, 157 R, 157 C, 159 R, 159 C, 163, 166; 439/4, 13

[56] References Cited

U.S. PATENT DOCUMENTS 3,068,316 12/1962 Witt ..... 339/119 C X
3,310,623 3/1967 Vaughan ..... 339/119 C X

FOREIGN PATENT DOCUMENTS 2620432 11/1977 Fed. Rep. of Germany ... 339/119 C
2638617 3/1978 Fed. Rep. of Germany ... 339/119 C

*Primary Examiner*—Z. R. Bilinsky
*Attorney, Agent, or Firm*—Charles H. Schwartz; Ellsworth R. Roston

[57] ABSTRACT

A wire and cable manager consisting of a low profile partitioned tray surrounded by an enclosure and containing an integral series of powered receptacles, capable of organizing, shortening and containing excess length, and supplying power to a number of power cords, cables or wiring, especially where a group of small appliances or electronic components are used in combination. The top of the device is suitable for stacking one or more components, such as a computer monitor or stereo amplifier.

4 Claims, 5 Drawing Figures

WIRE AND CABLE MANAGER

BACKGROUND

The management of the power and connection requirements of electrical components and small appliances is a problem, particularly in office workstations and on-home and industrial worksurfaces. The problem is the result of an increase in the number of electrical and electronic devices in current use and the simple fact that most power cords and connectors are of fixed length. Office microcomputers and home stereo systems typify the situation of a group of components used in combination, in close physical proximity, electrically powered and interconnected. The result is that behind a stack of such components is inevitably a tangle of wiring. The present invention addresses this problem comprehensively (wires of different groups and lengths, both powered and non-powered are accommodated), efficiently (wires are organized and clearly routed), and economically (the total number of wires crossing a worksurface is reduced and the device can fit nestly under many different components so that it does not require additional surface area for use). Power supplies with internal surge protectors configured to fit beneath computer monitors are presently in use; however, no provision is made in these products for cable shortening or managing and storing excess lengths of wiring and it is precisely for this reason that the present invention is unique and offers a substantial improvement.

SUMMARY

The present wire and cable manager consists of a very low profile enclosure, housing a sliding tray which has not only an integral power source, but which also creates a large partitioned interior cavity for storing excess lengths of wiring in narrow elongated coils. The device is configured as a low platform to fit easily beneath an electrical appliance, component or group of components, such as a microcomputer or stereo system, and thus requires a minimum of excess surface to perform its function. Its physical shape permits the location of wired components very near the device; therefore, the efficacy of the device is enhanced.

The wire and cable is used by sliding the tray partially forward in its enclosure, which is open front and back to expose the interiors compartment. Wires are fed through the rear of the enclosure and formed into a narrow elongated coil which may then be nested into one of the partitioned sections of the tray. If it is a power cord, its plug is inserted into an outlet; if it is a non-powered wire connector (such as speaker wire), the coil is simply allowed to rest in the partitioned section. Power is controlled at the front panel of the tray either by a master switch for the whole unit or by individual switches for each receptacle.

The primary object of the invention, then, is to be a general purpose wire and cable manager capable of organizing power cords and wiring and allow excess lengths of the connectors from adjacent electrical appliances or components to be coiled and stored neatly within the device.

Another object of the invention is to provide power to adjacent electrical components with a power supply and a multiplicity of internal power receptacles, along with individual switching capability.

Further objects and advantages will be evident from the following description, with reference to the drawings.

DETAILED DESCRIPTION

Figure 1:
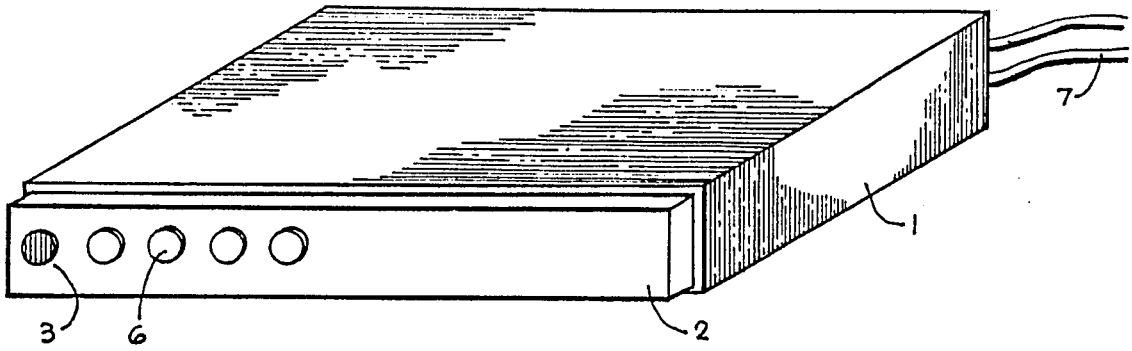
FIG. 1 is a perspective view of the present invention.

Looking now at the invention in more detail, with reference to FIG. 1, it can be seen that the device consists of a very low profile enclosure entirely open across its front (1), into which a tray (2) of substantially similar dimensions may slide freely. A series of power outlets is integrated into the front portion of the tray for the supply of power to cords brought into the wire manager. On-off type switches offer master (3) or individual (6) control of power.

Figure 2:
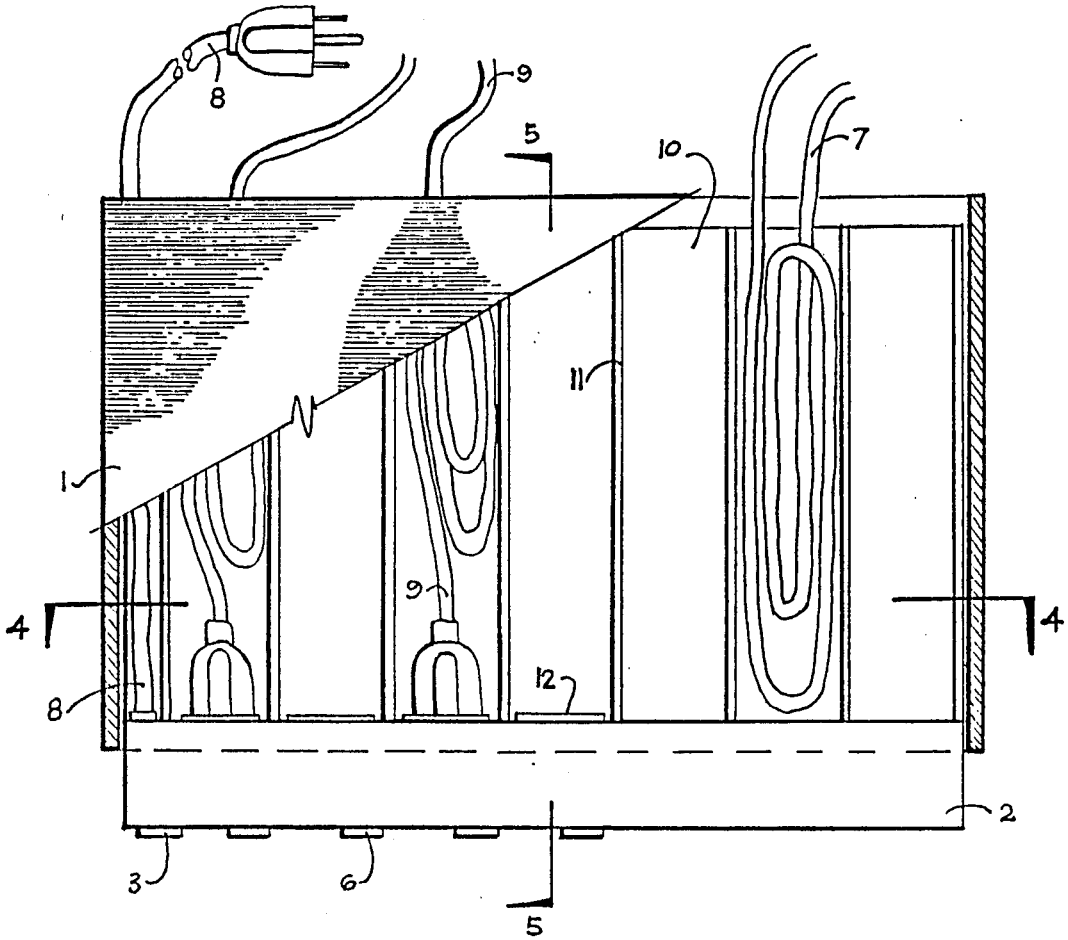
FIG. 2 is a top view of the device with a portion of the enclosure removed to show the interior of the device.

The function of the device is illustrated in FIG. 2, in which the enclosure (1) has been cut away to show the configuration of the device in top view. The tray (2) element of the device consists of a forward section furnished with power outlets (12) controlled as a group or individually by electrical switches (3, 6). This power section of the tray element receives its own power from an external source via a standard power cord (8).

The main body of the tray element (10) is divided into parallel elongated compartments by removable partitions (11) and can accommodate either powered (9) or non-powered (7) wiring. Note that in the preferred embodiment the rear panel of the enclosure (1) is shown entirely open which means that a wire or cable may be inserted into any compartment. It should be noted that the enclosure may take a variety of forms depending on materials and method of fabrication; in all cases, the rear of the enclosure must permit cables to be inserted at any location desired.

The operation of the device proceeds in the following manner: the tray (2) is slid forward enough to expose a portion of the interior cavity. The plug of a power cable (9) is inserted through the back of the device into any empty partitioned compartment and pushed through until the plug appears at the front. An appropriate sized elongated coil is formed as desired within the compartment (10) and placed neatly between the partitions (11). Finally the cord is plugged into the power receptacle with the compartment. A device so connected may then be operated directly from the switches provided on the front panel. A non-powered cord or cable may be similarly contained within the device with its excess length is formed into an elongated coil and held simply by friction between two partitions in the non-powered partion of the device. After all wires have been connected and compartmented, the tray is slid forward into a closed position, approximatly as shown in FIG. 2.

Figure 3:
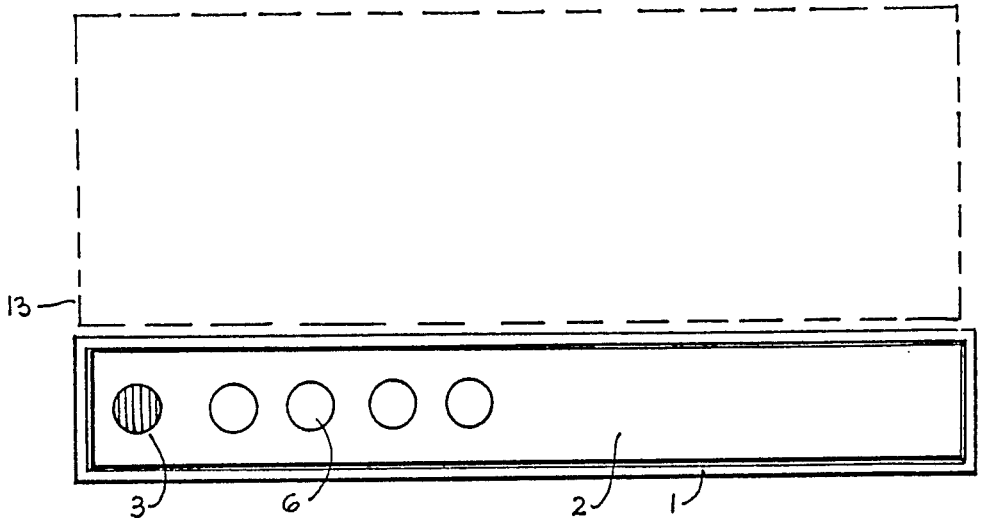
FIG. 3 is a front elevation of the invention.

The invention intentionally arrays its internal wire compartments in a laterally adjacent manner so that the device may be of minimum height, but of appropriately large width and depth, thus forming the overall shape of of a very low profile platform, substantial enough for placement of one or more electrical components or appliances directly on its top surface, as indicated in FIG. 3, numeral 13. An example would be a stack of stereophonic sound reproduction equipment in common household use. Other uses, such as with data processing equipment and the like is anticipated. All of the wire management and power requirements of components so stacked, in close proximity and atop the present invention, are easily handed by the wire and cable manager herein described.

Figure 4:
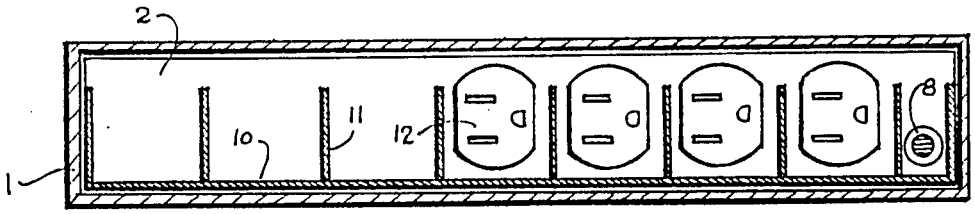
FIG. 4 illustrates a longitudinal cross section through the invention.
Figure 5:
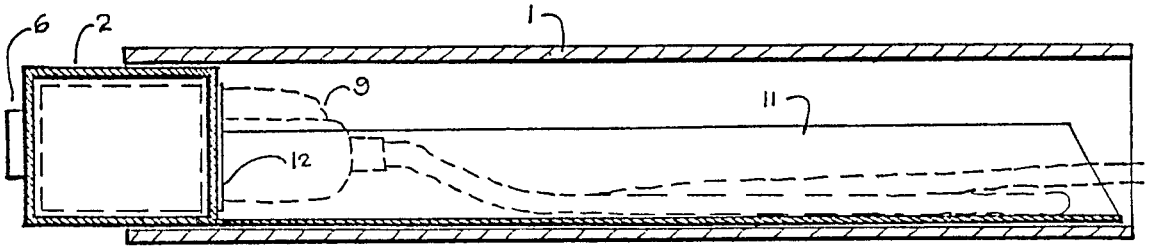
FIG. 5 shows a transverse cross section through the invention.

FIG. 4 shows an interior view of the device looking from the back and in longitudinal cross section. Numeral 2 points to the power portion of the tray element (2), being supplied with power by its own power cable (8) and containing a multiplicity of power outlets (12). Note again that the main body of the tray element is divided into laterally adjacent compartments (10) by partitions (11). The dotted outline within the power section indicates a cavity for conventional interconnection of power, power outlets and switches.

We claim:

1. In a wire and cable manager, enclosure means having an open front side and at least an additional aperture means, containing means located within the enclosure means and providing lateraly adjacent compartments into which excess length of power cords or wiring of any common small appliance or electric component may be inserted and then formed into substantially elongated coils and with the aperture means provided in the enclosure such that the remaining, uncoiled portion of said wiring, once inserted and coiled within the device may be allowed to exit to the exterior, and wherein said containing means consists of a single tray of dimensions substantially similar to that of the inside of the enclosure means and with said enclosure means open along the entirety of its open front side such that the tray may slide in and out, and with the opposite end of the tray substantially accessible through the aperture means in the enclosure.

2. A wire and cable manager as recited in claim 1 in which said sliding tray is furnished with removable and reconfigurable partitions to adjust the size of compartments for holding coils of wiring.

3. A wire and cable manager as recited in claim 1 in which a portion of said sliding tray is furnished with an internal power supply and appropriate receptacles such that power cords inserted and coiled within the device may terminate via a direct connection of the power plug of said power cord to the power receptacle of said power supply.

4. A wire and cable manager as recited in claim 3 in which said power supply is furnished with on-off switches for both the collective and individual control of power to the power cords connected with the device.

* * * * *